United States Patent [19]

Lacelle

[11] 4,363,497

[45] Dec. 14, 1982

[54] SKI TRACTION DEVICE

[76] Inventor: Gilles Lacelle, 32 Glenwood Dr., Aylmer, Quebec, Canada, J9H 1H7

[21] Appl. No.: 212,423

[22] Filed: Dec. 3, 1980

[51] Int. Cl.[3] ..... A63C 7/00

[52] U.S. Cl. ..... 280/604; 280/809

[58] Field of Search ..... 280/604, 809, 818; 188/8

[56] References Cited

U.S. PATENT DOCUMENTS 4,227,708 10/1980 Cote ..... 280/604 X

FOREIGN PATENT DOCUMENTS 1041566 10/1978 Canada ..... 280/604

185699 12/1936 Switzerland ..... 280/604

*Primary Examiner*—Joseph F. Peters, Jr.

*Assistant Examiner*—Michael Mar

[57] ABSTRACT

A traction device for skis is provided. An arm having a loop is pivotally mountable on a ski immediately ahead of a ski harness. The end of the arm distal from its pivot mount has a loop adapted for engagement with the point and basket of a ski pole. A skier employs his ski poles to pivot the arms to a position on the outer side of his skis whereby the point of a ski pole serves to hold one ski stationary while the other ski is advanced.

2 Claims, 5 Drawing Figures

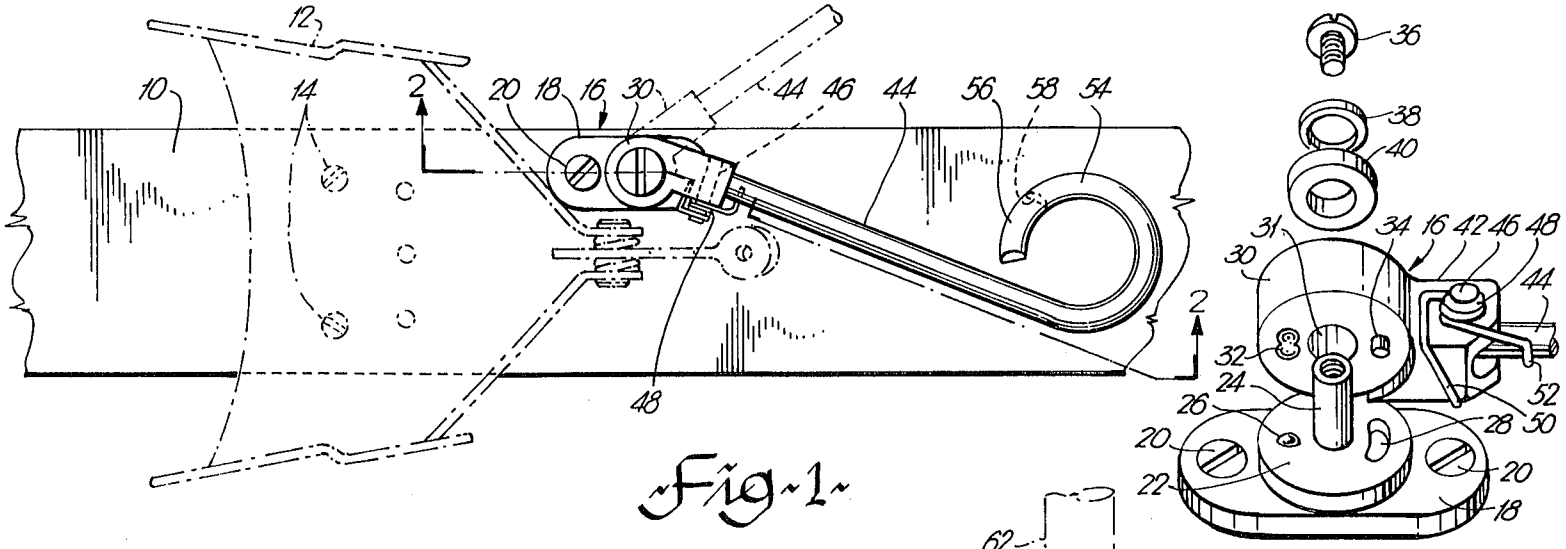
Fig. 1
Fig. 3
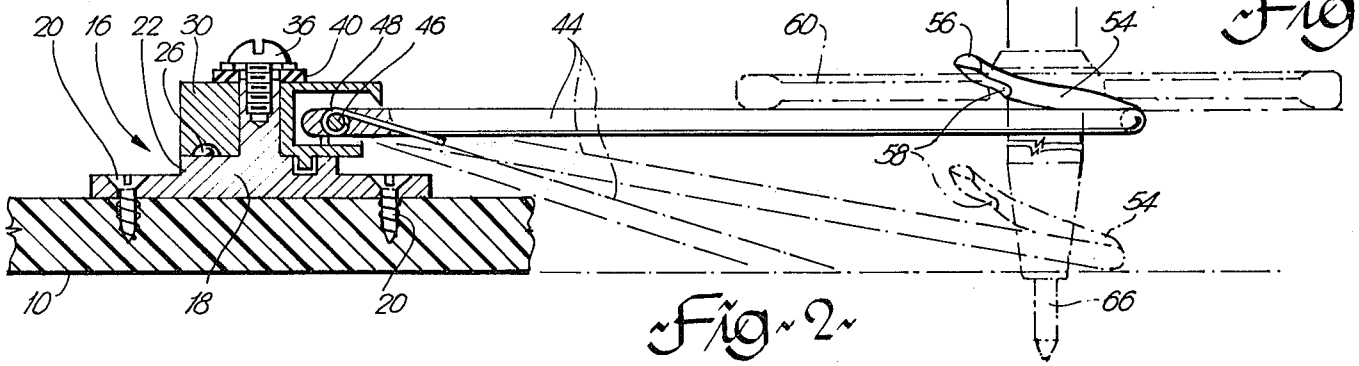
Fig. 2

SKI TRACTION DEVICE

This invention relates to a device to assist skiers in climbing icy slopes or in traversing icy surfaces such as roads or the like and in climbing snow-covered slopes. The device is designed for use by both cross-country and Alpine skiers.

In the past many devices have been created in an attempt to assist skiers climbing icy slopes or crossing icy surfaces, such devices generally being directed to hinged spikes or the like which are affixed to the ski, and which the skier selectively manipulates in order to gain traction.

The present invention is directed to a traction assist for skis whereby the skier using the tip of his ski pole is able to move the device according to the invention from its inoperative to its operative position, after which the tip of the ski pole itself provides traction means, whereby one ski is held in a stationary position while the other ski is advanced. Thus, the traction device according to the invention is provided on each ski.

In addition to assisting a skier traverse an icy surface, the device will also provide good traction when a skier is climbing a slope which is covered relatively thickly with snow.

An object of the invention is to provide a ski pole traction device mounted on each of a pair of skis slightly forward of the harness, whereby an arm may be pivoted from its inoperative position above the ski to a position on the outer side of the ski, the device being adapted to receive the tip of a ski pole, whereby when the ski pole tip is inserted therein and urged downwardly toward ice or snow being traversed, the ski associated therewith may be held in a stationary position, while the other ski is advanced.

A principal object of the invention is to provide a traction assist device for skis comprising a pivot body adapted for mounting on a ski ahead of a ski harness; an arm extending from said body, said arm terminating in a loop; said arm being adapted for selective pivotal movement from a position above a ski to a position whereby its end loop is extended to one side of the ski; said loop being adapted to receive the tip of a ski pole Reference will now be made to the accompanying drawings wherein:

FIG. 1 is a top plan view of a portion of a ski illutrating a ski harness in broken lines and the traction device according to the invention;

FIG. 2 is a sectional view taken along line 2—2 of FIG. 1, with a ski pole shown in broken lines;

FIG. 3 is an exploded view of the traction pivot; and

Detailed reference with now be made to the drawings wherein like reference numerals will be used to identify like parts.

Figure 4:
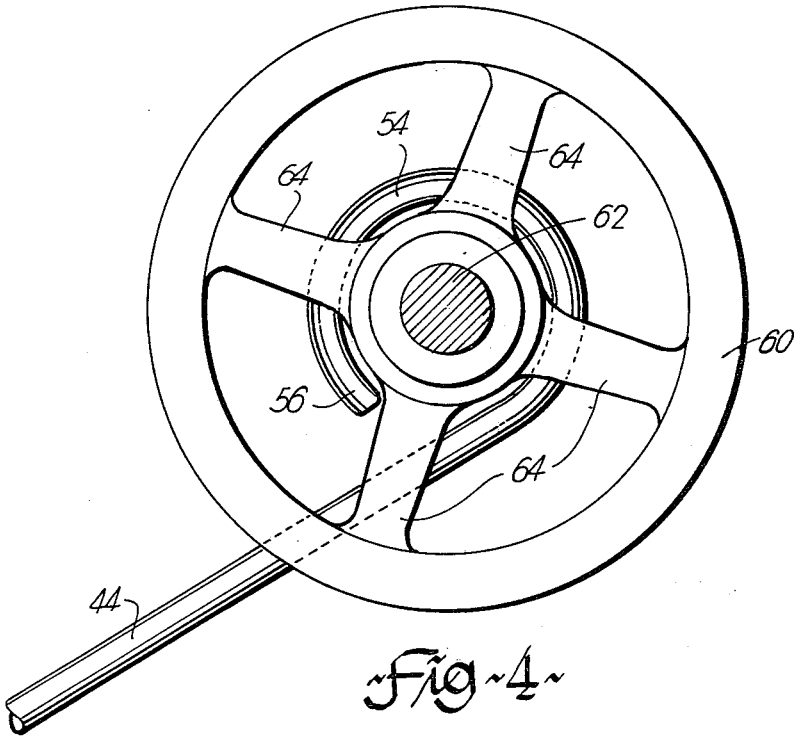
FIGS. 4 and 5 are top plan views of the outer end of a traction arm, with a ski pole engaged therewith, in unlocked and locked positions respectively.

As seen in FIG. 1 a portion of a ski 10 has a cross-country harness 12 mounted thereon by means of screws 14. While a cross-country harness is shown for purposes of illustration it will be evident that the invention described herein will find equal use with Alpine skis. It will be further appreciated that a left-hand ski 10 is illustrated herein, and its counterpart right-hand ski will be a mirror image thereof.

Referring to FIGS. 1, 2 and 3 a pivot assembly is indicated generally at 16, assembly 16 including a base member 18 adapted to be affixed to a ski, as illustrated, by screws 20. Base member 18 includes a unitary circular upwardly projecting disc-like member 22, centrally thereon. A central, cylindrical post 24 is unitary with disc 22 and projects upwardly therefrom, post 24 being internally threaded. The upper face of disc 22 is provided near one edge with an upwardly projecting unitary semi-spherical projection 26 thereon, and diametrically opposed from projection 26 is an arcuate indentation 28.

A pivot member 30, the main body of which is generally circular is provided with a central hole 31 adapted to be received by cylindrical projection 24 of base member 18. The bottom face of member 30 is provided with a pair of interconnecting semi-spherical identations 32, near one edge thereof, and diametrically opposed to said indentations 32 is a downwardly projecting finger 34 adapted to be received in arcuate indentation 28. Pivot member 30 is adapted to be positioned on post 24, with finger 34 projecting into arcuate indentation 28, and with projection 26 projecting into one of the pair of interconnecting identations 32, and to be maintained in position thereon by means of screw 36 adapted for threaded engagement within post 24. A metal washer 38 is adapted to be positioned above a relatively thick rubber washer 40, washer 40 affording the necessary resilience to permit partial rotation of pivot member 30, during operation, for example, from the position illustrated in FIG. 1 in solid and in broken lines. It will be appreciated that the resilience of washer 40 permits pivot member 30 to elevate slightly as it is rotated, and projection 26 passes from one side of indentation 32 to the other. It will be further appreciated that resilient washer 40 may be eliminated, and rather than a fixed semi-spherical projection 26, a spring-loaded semi-spherical ball provided in disc 22.

Projecting outwardly from pivot member 30 is a short unitary projection 42, from which an arm 44 projects. Arm 44 is pivotally connected to projection 42 by a pin 46 at its inner end, whereby limited vertical pivoting movement is provided. Arm 44 is normally urged to the horizontal position illustrated in FIG. 2 under the urging of spring 48, spring 48 being mounted on one end of pin 46, and having unitary extensions 50 secured to unitary projection 42 of pivot member 30, and projecting ball bearing 26 seated in disc 22 and projecting upwardly therefrom, and diametrically opposed from ball bearing 26 is an arcuate indentation 28.

A pivot member 30, the main body of which is generally circular is provided with a central hole 31 adapted to be received by cylindrical projectiong 24 of base member 18. The bottom face of member 30 is provided with a pair of interconnecting semi-spherical indentations 32, near one edge thereof, and diametrically opposed to said indentations 32 is a downwardly projecting finger 34 adapted to be received in arcuate indentation 28. Pivot member 30 is adapted to be positioned on post 24, with finger 34 projecting into arcuate indentation 28, and with ball bearing 26 projecting into one of the pair of interconnecting indentations 32, and to be maintained in position thereby by means of screw 36 adapted for threaded engagement within post 24. A metal washer 38 is adapted to be positioned above a relatively thick rubber washer 40, washer 40 affording the necessary resilience to permit partial rotation of pivot member 30, during movement, for example, from the position illustrated in FIG. 1 in solid and in broken lines. It will be appreciated that the resilience of washer 40 permits pivot member 30 to elevate slightly as it is rotated, and ball bearing 26 passes from one side of identation 32 to the other.

Projecting outwardly from pivot member 30 is a short unitary projection 42, from which an arm 44 projects. Arm 44 is pivotally connected to projection 42 by a pin 46 at its inner end, whereby limited vertical pivoting movement is provided. Arm 44 is normally urged to the horizontal position illustrated in FIG. 2 under the urging of spring 48, spring 48 being mounted on one end of pin 46, and having unitary extensions 40 secured to unitary projection 42 of pivot member 30, and its other end 52 engaging the underside of arm 44.

Arm 44 terminates at its outer end in an open loop-coil 54 with its outermost end 56 being coiled slightly upwardly as illustrated in FIG. 2. It will also be seen that the end 56 of loop-coil 54 is semi-circular in cross-section with the bottom thereof being flat, thus providing a lip 58. Arm 44 is preferably manufactured of hardened piano wire.

Figure 5:
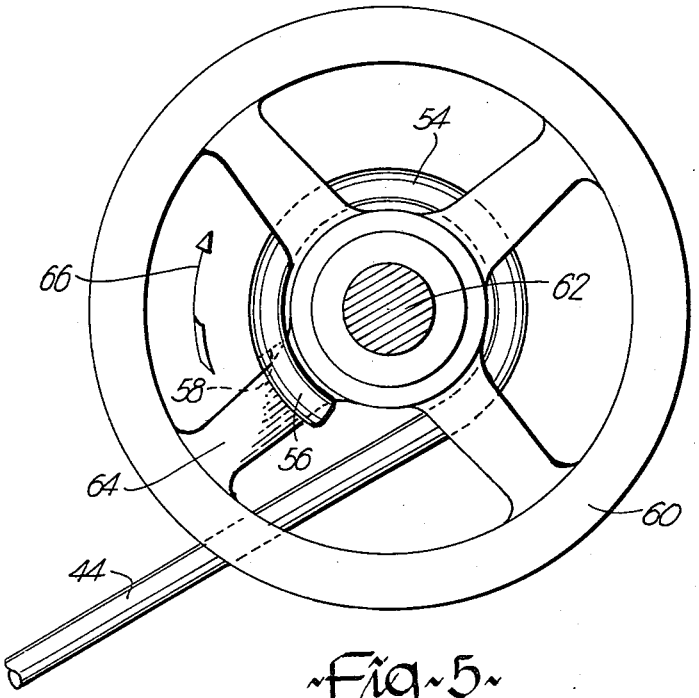

Referring now to FIGS. 4 and 5, arm 44 is shown in the position illustrated in broken lines in FIG. 1, relative to ski 10. That is, arm 44 projects upwardly to the side of ski 10, whereby loop-coil 54 is then spaced from the side of ski 10 a sufficient distance to permit a ski pole basket 60 clearance between the outer edge of ski 10 and the closest portion of a ski-pole basket 60. Ski pole 62 is illustrated in section in FIGS. 4 and 5. As seen in FIG. 4 all four connecting arms 64 of basket 60 are above loop-coil 54 of arm 44. As seen in FIG. 5, upon rotation of ski pole 62, and its associated basket 60, in the direction of arrow 66 of FIG. 5, arm 64 of basket 60 is urged under the end 56 of coil-loop 54, until it engages lip 58 thereof, thus preventing further rotation. Basket 60 may be disengaged from end 58 of coil-loop 54 by rotation in the direction opposite to arrow 66, when it is desired to remove the ski pole from association with coil-loop 54.

The pivot assembly 16 and a portion of arm 44 adjacent assembly 16 will preferably be surrounded by a rubber boot, not illustrated, to prevent entry of snow or ice, during use.

In operation, when a skier encounters an icy slope, or requires traction for any reason, the device according to the invention is used as follows. Firstly, tip 66 of ski pole 62 is positioned in the center of coil-loop 54, and the skier urges coil-loop 54 outwardly away from ski 10, until arm 44 is in the position illustrated in broken lines in FIG. 1. It will be appreciated that as arm 44 pivots from its position shown in solid lines in FIG. 1 to the position illustrated in broken lines in FIG. 1 that restraint finger 34 moves within the limits of arcuate identation 28, that is, from its innermost to its outermost position, and concurrently ball bearing 26 is forced from one side of the pair 32 of semi-spherical indentations of member 30, causing washer 40 to be slightly compressed during this rotation, and whereby the arm is maintained in the position illustrated in broken lines in FIG. 1 until it is again urged by the tip 66 of ski pole 62 to the inoperative position illustrated in solid lines in FIG. 1.

In order to maintain ski 10 in a fixed position, the skier pushes tip 66 of ski pole 62 downwardly, whereby the basket 60 urges coil-loop 54 of arm 44 downwardly, until traction with a supporting surface is achieved. Referring to FIG. 2 it will be seen that arm 44 may be pivoted downwardly against the urging of spring 48, until coil-loop 54 thereof is approximately two inches lower than the riding surface of ski 10.

In order to ascend a slope in deep snow, a skier with both traction devices in operative position may selectively rotate baskets 60 of ski poles 62, to engage with the end 56 of coil-loop 54, and by alternately lifting and advancing a ski and its associated pole, make easy headway.

The foregoing is by way of example only and the invention should be limited only by the scope of the appended claims.

The embodiments of the invention in which an exclusive property or privilege is claimed are defined as follows:

1. A traction assist device for skis comprising a base member fixedly mounted on said ski ahead of a ski harness, and a substantially rigid arm extending from said base member and terminating at its outer end in a loop adapted to receive the tip of a ski pole, the inner end of said arm being pivotally mounted on said base to be selectively movable between a first position above the ski and a second position wherein said loop is extended to one side of the ski;

said base member including resilient means and detent means for maintaining said arm in each of said first position above said ski and said second position to one side of said ski;

means for pivotally mounting said arm to said base member for movement between an upper position slightly above the top plane of said ski and parallel therewith to a lower position wherein said loop is below said ski; and spring means for biasing said arm in said upper position, whereby said arm, when in said second position to one side of said ski, is adapted to be moved to said lower position under the urging of a ski pole tip placed in said loop.

2. A traction assist device for skis according to claim 1 wherein said loop is open and is coiled slightly upwardly at its open end and has a lip thereon, whereby a ski pole basket may be selectively engaged therewith.

* * * * *